US005295891A

United States Patent [19]

Schalk

[11] Patent Number: 5,295,891

[45] Date of Patent: Mar. 22, 1994

[54] HOLDING DEVICE FOR INFLATABLE BALLOONS

[76] Inventor: Alfons Schalk, Osteranger 3, D-8197 Königsdorf, Fed. Rep. of Germany

[21] Appl. No.: 847,091

[22] PCT Filed: Oct. 12, 1990

[86] PCT No.: PCT/EP90/01734

§ 371 Date: Jun. 9, 1992

§ 102(e) Date: Jun. 9, 1992

[87] PCT Pub. No.: WO91/05592

PCT Pub. Date: May 2, 1991

[30] Foreign Application Priority Data

Oct. 12, 1989 [DE] Fed. Rep. of Germany ..... 8912171
Mar. 2, 1990 [DE] Fed. Rep. of Germany ..... 9002459

[51] Int. Cl.[5] ..... A63H 27/00

[52] U.S. Cl. ..... 446/222; 446/485; 362/806

[58] Field of Search ..... 446/220, 222, 225, 485; 362/186, 806, 810, 253; 40/214

[56] References Cited

U.S. PATENT DOCUMENTS

| | | | |
|---|---|---|---|
| 1,229,794 | 6/1917 | Salzer | 446/220 X |
| 3,250,241 | 5/1966 | Levy et al. | 446/220 X |
| 3,411,778 | 11/1968 | Barry | 446/220 X |
| 4,715,841 | 12/1987 | Nelson et al. | 446/222 |
| 4,729,749 | 3/1988 | Milne | 446/222 |
| 4,737,133 | 12/1988 | Neumeier | 446/222 X |
| 4,794,498 | 12/1988 | Neumeier | 362/186 |
| 4,798,554 | 1/1989 | Nelson et al. | 446/222 |

FOREIGN PATENT DOCUMENTS

| | | | |
|---|---|---|---|
| 0221008 | 5/1987 | European Pat. Off. . | |
| 8905690 | 7/1989 | Fed. Rep. of Germany . | |
| 1063722 | 5/1954 | France | 446/220 |

*Primary Examiner*—Mickey Yu
*Attorney, Agent, or Firm*—Ostrolenk, Faber, Gerb & Soffen

[57] ABSTRACT

A holding device for inflatable balloons or the like which have a balloon envelope and a filling connection has a holding part which has clamping means for the airtight clamping off of the filling connection of the balloon after its inflation. The holding part has the shape of a bowl (2; 2') which is open towards the balloon (1), and the clamping means comprise a groove (6, 7; 6', 7') which is formed in the circumferential wall of the bowl (2; 2') and passes through said circumferential wall, the groove extending from the edge (2a) of the bowl (2; 2') that rests against the balloon envelope upon use and being intended to receive the filling connection (3) of the balloon 1), and a clamping device (4) for the end of the filling connection (3) of the balloon (1) arranged on the outside of the circumferential wall of the bowl (2; 2').

15 Claims, 6 Drawing Sheets

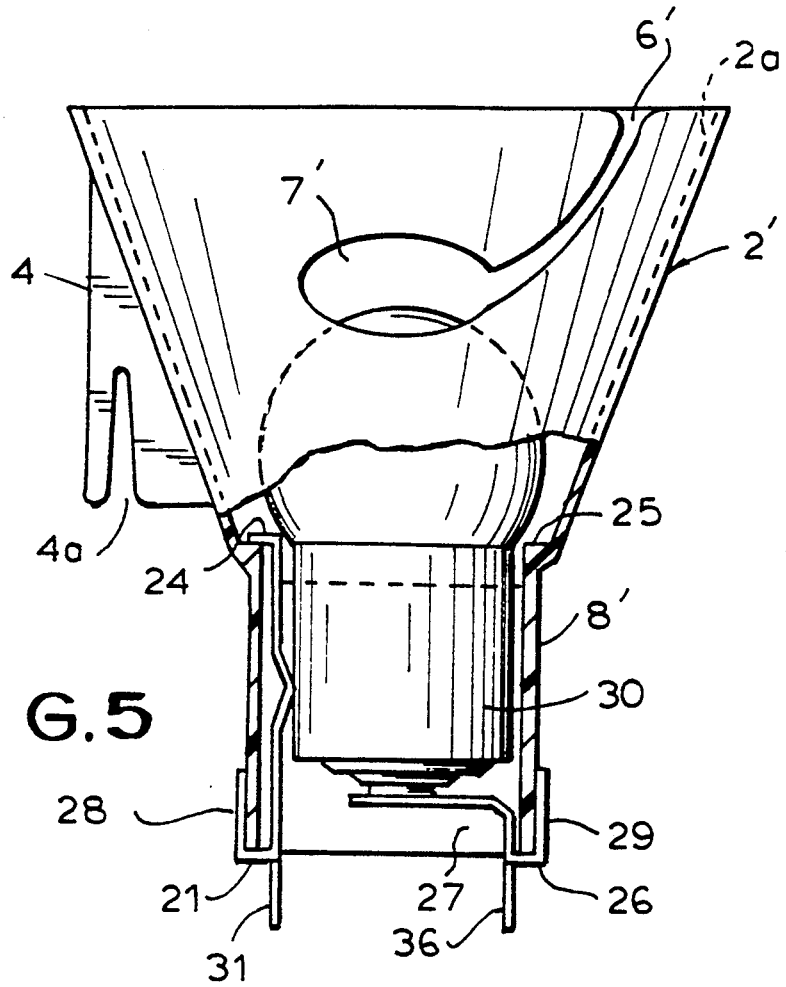
FIG.5
FIG.6
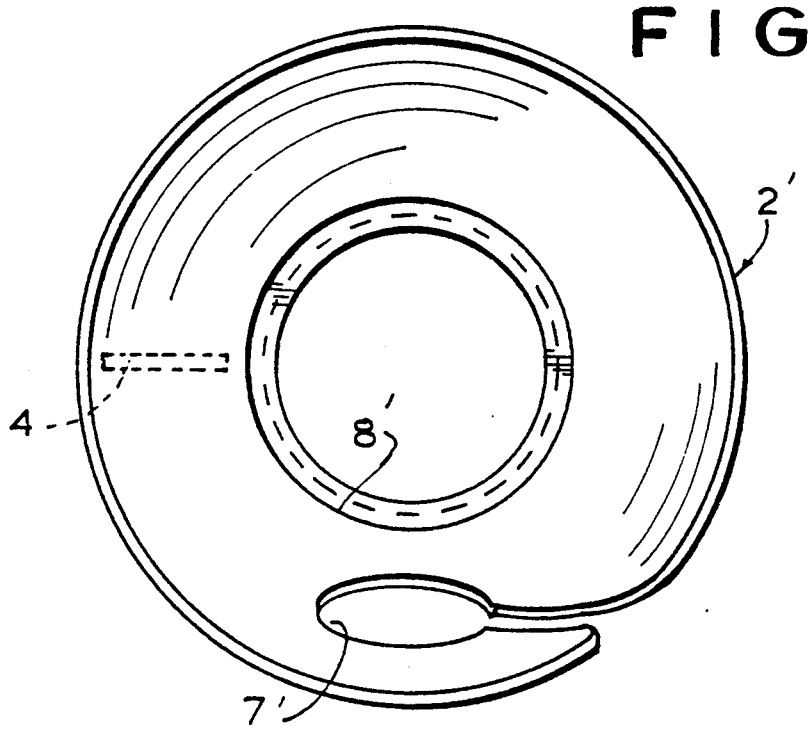

HOLDING DEVICE FOR INFLATABLE BALLOONS

FIELD OF THE INVENTION

The present invention relates generally to a holding device for an inflatable balloon, and more particularly relates to a holding device of this type that supports a device for illuminating the balloon.

BACKGROUND OF THE INVENTION

A large number of holding devices or holding measures for inflatable balloons are known. In the simplest form, the filling connection of the balloon is tied off by a rope or the like after inflation, the rope at the same time forming a holding device for the balloon. This tying must be effected with great care if assurance is to be had that an airtight closure of the balloon is retained for a long time. It is also known to knot the filling connection of a balloon itself in order to produce the airtight closure. All of these measures are time-consuming and they are not entirely satisfactory from the standpoint of aesthetic appearance.

A holding device is also known which consists of a bar having an end that faces the balloon, and to this end there is fastened a wire helix which widens in funnel shape towards the balloon or a spring on which the filling connection of the balloon is fastened. In this case also, separate clamping measures are generally required for the airtight closure of the balloon.

From Federal Republic of Germany De-U1 87 11380, an illuminating device for inflatable balloons is known in which the illuminating device can either be pushed into the filling connection of an inflatable balloon or inserted in sealed manner in a recess within the balloon. In both cases the illuminating devices must in their turn be provided with filling connections in order to permit the filling of the balloon. For this it is necessary that these illuminating devices, as such, form an airtight unit, which results in a complicated construction and comparatively high weight. Furthermore, the handling of these illuminating devices and particularly their attachment to the balloon is difficult.

From Federal Republic of Germany U1 89 05 690, there is known another illuminating device for inflatable balloons which has the shape of a bowl the open edge of which can be attached by adhesives, fastening extensions or a circumferential flange to the balloon envelope outside the region of the filling connection. In this case, however, a separate closing of the filling connection is necessary.

From U.S. Pat. No. 3,411,778, finally, a holding device of the aforementioned type for balloons on a target is known, the holding device having the shape of an outwardly widening cylindrical stabilizer the front end of which is fastened to the actual target and which has a slot extending forward from the rear edge of the holding device for pulling the filling connection of the balloon through it, the connection being wound around the front end of said stabilizer and held fast. A dependable sealing of the filling connection by the wrapping of the filling connection around the front end of the holding device cannot be obtained here, and the aesthetic appearance is not satisfactory. Furthermore, it cannot be seen how an illuminating device could be provided here.

SUMMARY OF THE INVENTION

The object of the present invention is to create a holding device of the aforementioned type which, while being of simple construction and of low weight, can be easily handled for the airtight closing of the balloon and permits illumination of the balloon.

The development of the holding device in accordance with the invention does not require separate clamping devices or a knotting of the filling connection so that very simple handling results. After inflation, the filling connection of the balloon is simply pulled into the groove that is present in the circumferential wall of the bowl and then into the clamping device which clamps off the filling connection and seals it off.

By the simple development of the holding device which can be applied very rapidly and easily to the balloon envelope, manufacture is much simpler and an improved results are obtained, it being possible after use for the holding device to be removed very rapidly from the balloon and used again. The bowl of the holding device forms the reflector of an illuminating device for the balloon, a lamp socket being arranged on the bottom of the bowl.

A holding cord or a holding bar can be easily arranged on the bottom of the bowl, as is also otherwise customary in balloons.

A holding cord or a holding bar can be easily arranged on the bottom of the bowl, as is also customary in the case of balloons.

The lamp socket on the bottom of the bowl is developed preferably in a cylindrical extension. In this case, the holding cord or the holding bar is arranged on the cylindrical extension.

It has been found that it is readily possible to obtain a uniform illuminating of a balloon in the manner that the illuminating device is fastened merely to the outside of the balloon envelope, thus resulting in substantial simplification in the means for fastening to the balloon, it no longer being necessary to develop the illuminating device as an airtight unit. Furthermore, there are no restrictions with regard to the shape and dimensions of the illuminating device since it need not be adapted to the dimensions of parts of the balloon, such as for instance the filling connection.

By the simple development of the illuminating device, which can be employed with a large number of differently shaped incandescent bulbs and can be applied very rapidly and easily to the envelope of the balloon, substantially simplified manufacture and improved use result since the illuminating device can be removed very rapidly after use from the balloon and reused.

Furthermore, it is also possible to provide the illuminating device itself with a source of energy, for instance a button-type battery, or the illuminating device or a number of illuminating devices can be fed from a common source of energy which may possibly impart special illuminating effects, such as blinking or the like, to the individual illuminating devices. In order to obtain different light effects, a filter disk or dispersion disk can furthermore be provided in the reflector.

BRIEF DESCRIPTION OF THE DRAWINGS

Embodiments of the invention will be described in further detail below, with reference to the drawing, in which:

FIG. 5 is a side view of the embodiment of the holding device of FIG. 4;

FIG. 6 is a top view of the embodiment of the holding device of FIGS. 4 and 5;

DESCRIPTION OF THE PREFERRED EMBODIMENTS

Figure 1:
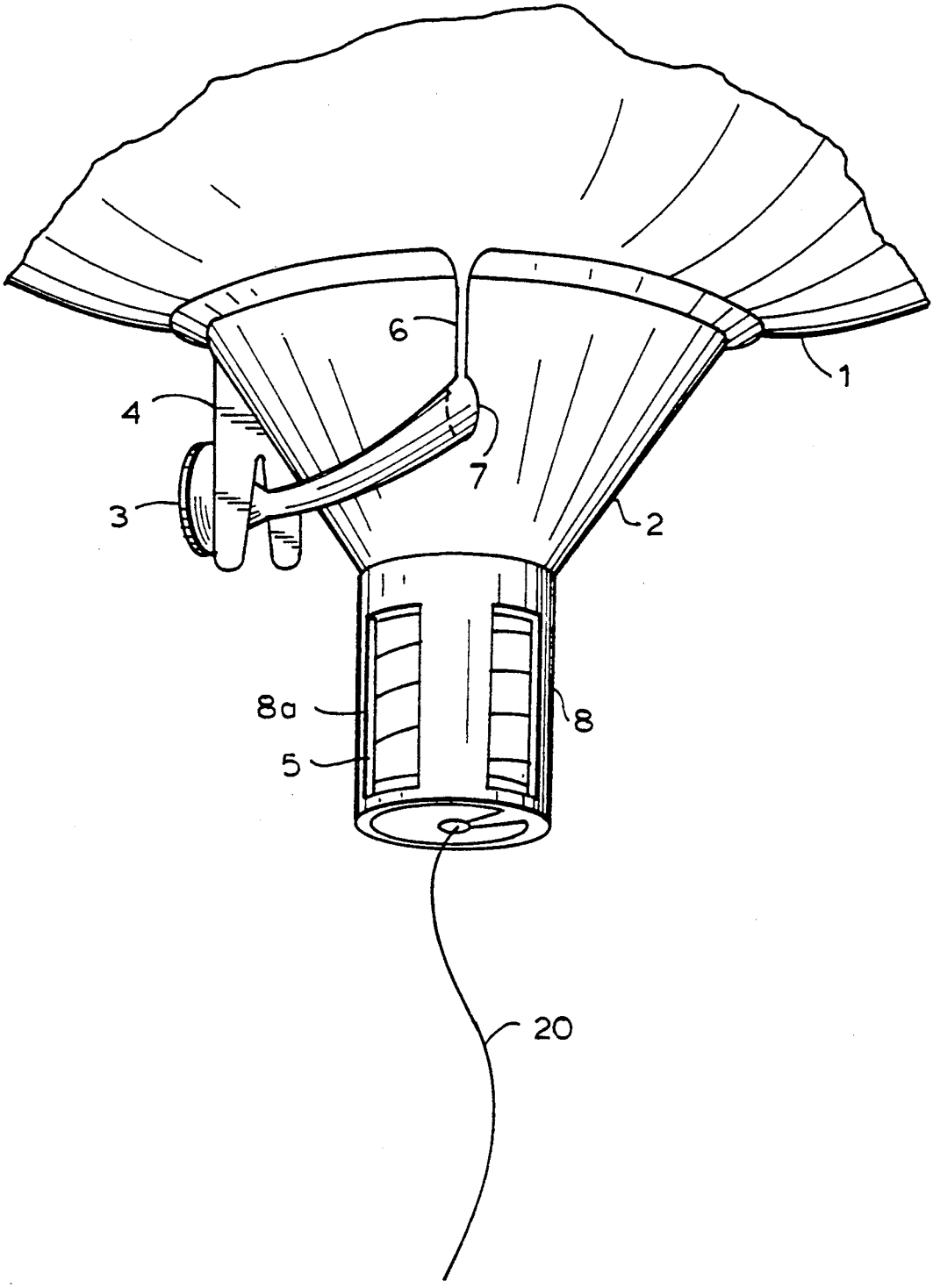
FIG. 1 diagrammatically shows a part of a balloon with one embodiment of the holding device fastened to it.

Reference will first of all be had to FIG. 1, which shows the general nature of the application of one embodiment (FIGS. 1-3) of the holding device to a balloon envelope.

As can be noted from FIG. 1, the embodiment of the holding device has, as holding part, a bowl 2, which has a frustoconical circumferential wall in the embodiment shown, but which could also be developed in the shape of a spherical segment or the like.

Figure 2:
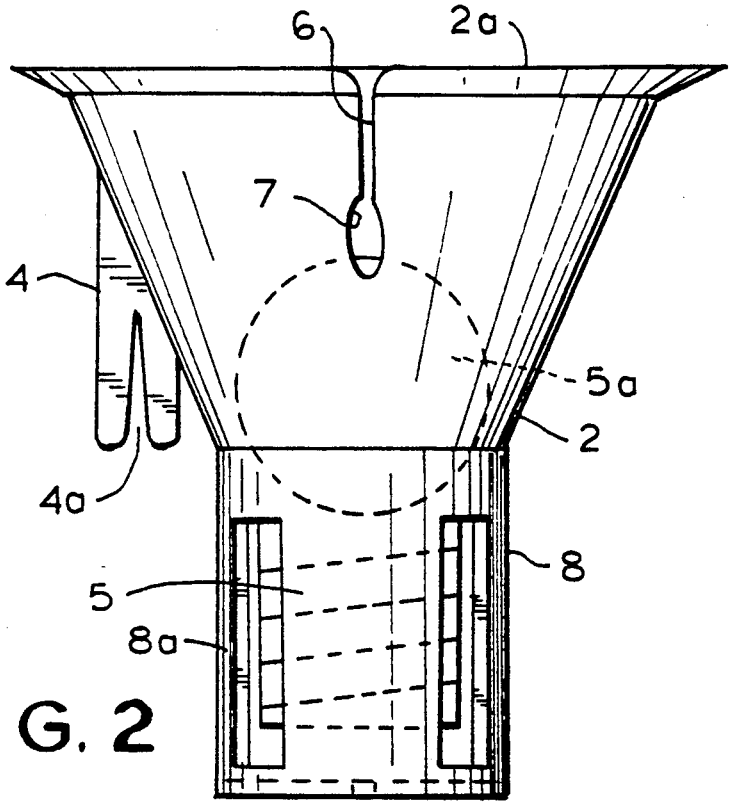
FIG. 2 is a side view of the embodiment of the holding device of FIG. 1.
Figure 3:
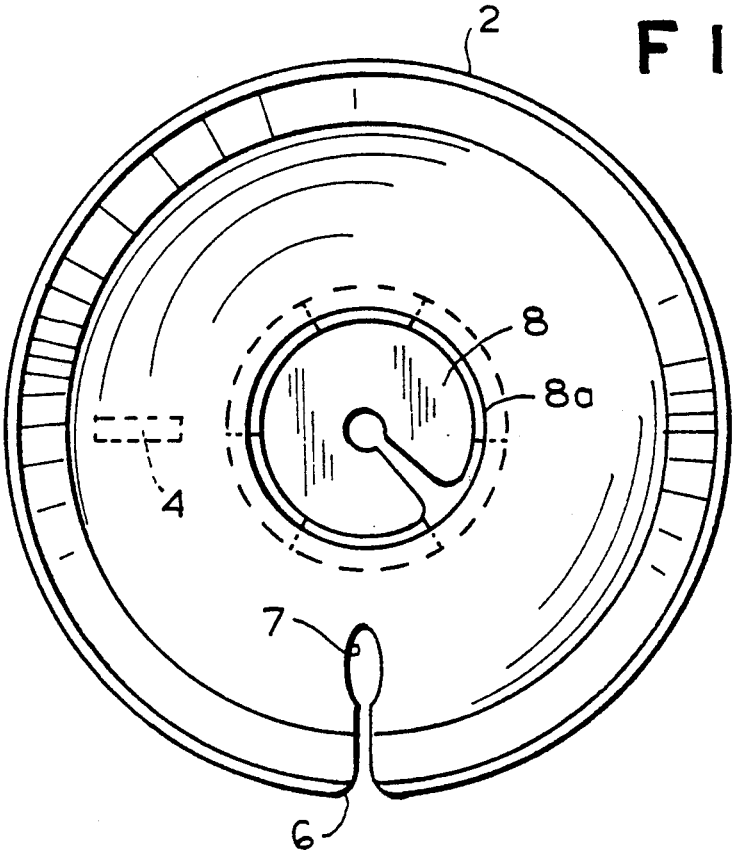
FIG. 3 is a top view of the embodiment of the holding device of FIG. 2.

The bowl 2 of FIGS. 2 and 3 is provided with a groove 6 which extends from the larger circumferential edge of the bowl and into which the filling connection 3 of the balloon 1 can be inserted.

In the embodiments shown in the drawings, the groove 6 terminates in a widened portion 7 and the filling connection 3 which is introduced into this widened portion 7 at the end of the groove 6 then extends to a clamping device in the form of a wall 4 which extends radially from the outer periphery of the bowl 2 and has a tapered clamping groove 4*a*. The free end of the filling connection 3 is fastened and hermetically closed in this clamping groove 4*a*.

The groove 6, in the same way as the groove 4*a* of the clamping device 4, could be tapered at its end so that the filling connection is additionally clamped off by being pulled into this tapered region and thus sealed off and clamped fast.

By this development of the holding device it is possible to fasten this holding device with the aid of the filling connection 3 to the balloon 1 without any further steps being necessary for the airtight closing of the filling connection.

The bowl 2 can advantageously form the reflector 2 of an illuminating device for the balloon. In such case, the bowl 2 is lengthened at the bottom thereof facing away from the balloon by a cylindrical extension 8 which receives a lamp socket 5 with an incandescent bulb 5*a*. The cylindrical extension 8 can either be integral with the bowl 2 or be developed as a part separate from it and adapted to be locked to it. In order to avoid thermal problems as a result of the heating up of the incandescent bulb 5*a*, this extension 8 is provided with vent openings in the form of interruptions 8*a* and the lamp socket 5 can be held by means of beads or projections developed on the inner wall of the cylindrical extension 8 at a distance from the latter.

As shown in FIG. 1, a holding rope 20 can be fastened to the bottom of the cylindrical extension 8. If this cylindrical extension 8 is not provided, this holding rope would of course be fastened to the bottom of the bowl 2.

Figure 4:
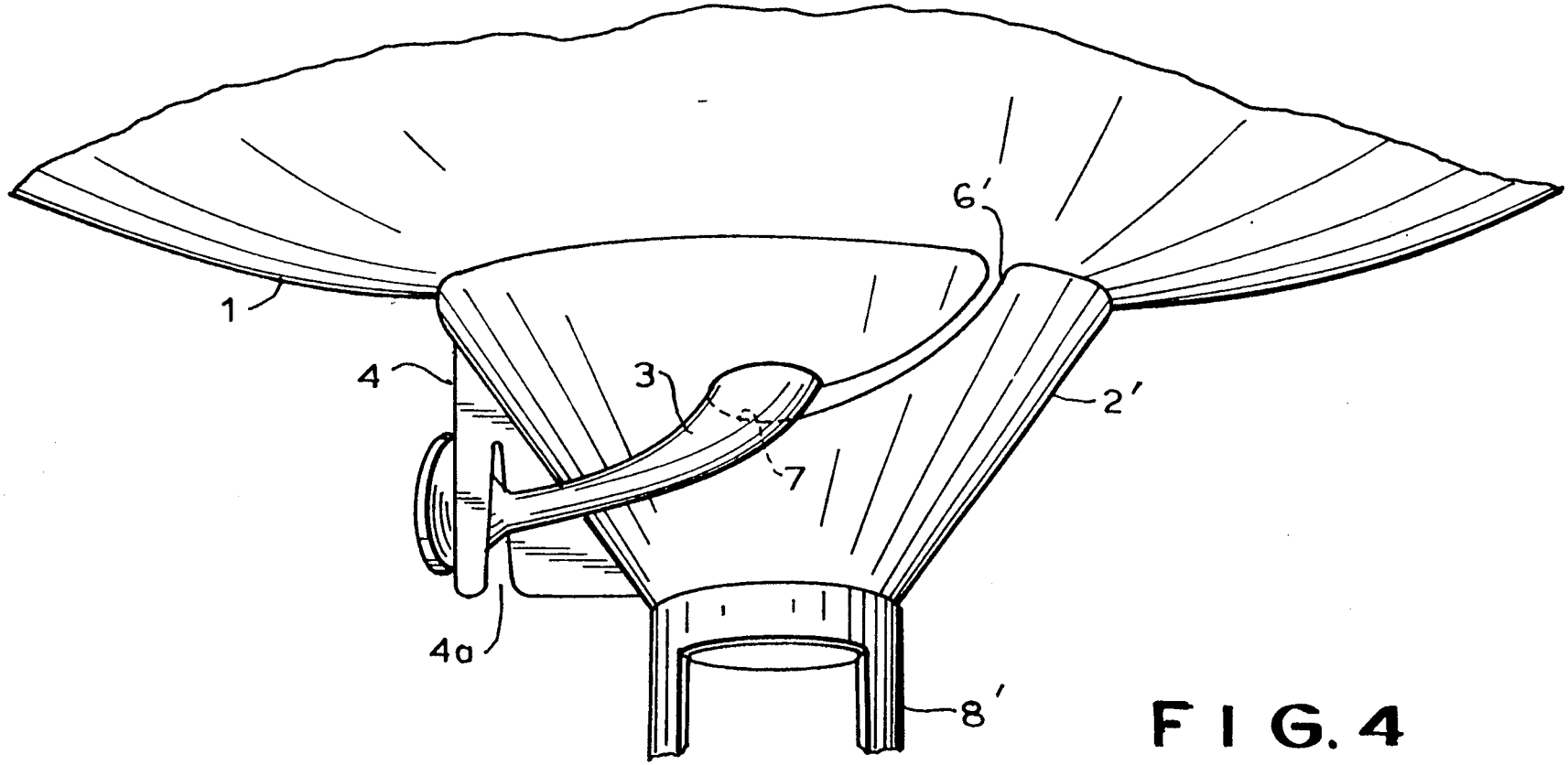
FIG. 4 is a diagrammatic showing of a part of a balloon with a modified embodiment of the holding device fastened to it.

The embodiment of the combined holding and illuminating device shown in FIGS. 4 to 6 differs from the embodiment of FIGS. 1 to 3 essentially by a different shape of the groove and of the illuminating elements.

In this embodiment, the groove 6′ in the circumferential wall of the bowl 2′ which forms a reflector commences from the edge 2*a* of the bowl 2′ which upon use rests against the balloon envelope 1 and it extends along a substantially helical line in the circumferential wall of the bowl 2′ in the direction towards the edge adjacent to the lamp socket 8′.

The groove 6′ can, in this connection, extend over a circumferential angle of about 90° in the circumferential wall of the bowl 2′, the width of the groove 6′ starting from the edge 2*a* possibly decreasing for the clamping of the filling connection (3) or terminating in a widened portion 7′ as shown.

On the outside of the circumferential wall of the bowl 2′, the clamping device 4 for the end of the filling connection 3 of the balloon 1 is again present, as described with reference to FIGS. 1 to 3.

The clamping device 4 is arranged on the circumferential wall of the bowl 2′, spaced for instance by a circumferential angle of about 90° from the end of the groove 6′.

Also in this embodiment the lamp socket 8′ is formed by a substantially cylindrical extension of the tapered end of the bowl 2′.

The lamp socket 8′ has a substantially cylindrical recess to receive the base (30) of the incandescent bowl and, within this recess, there is arranged a circumferential contact 21, 23, 24 which rests against the inner wall of the recess and a center contact 26, 27 which extends radially into the recess. The circumferential contact 21, 23, 24 is formed by a strip-shaped electrically conductive, elastic element lying against the inner wall of the recess and having a radially inward protruding bend 23 intended for engagement with the circumferential surface of the base of the incandescent bowl. The circumferential contact 21, 23, 24 and the center contact 26, 27 are fastened by bending their free ends 28 and 29 respectively around the edge of the cylindrical extension facing away from the bowl 2′ and have unbent connecting parts 31 and 36, respectively.

Figure 7:
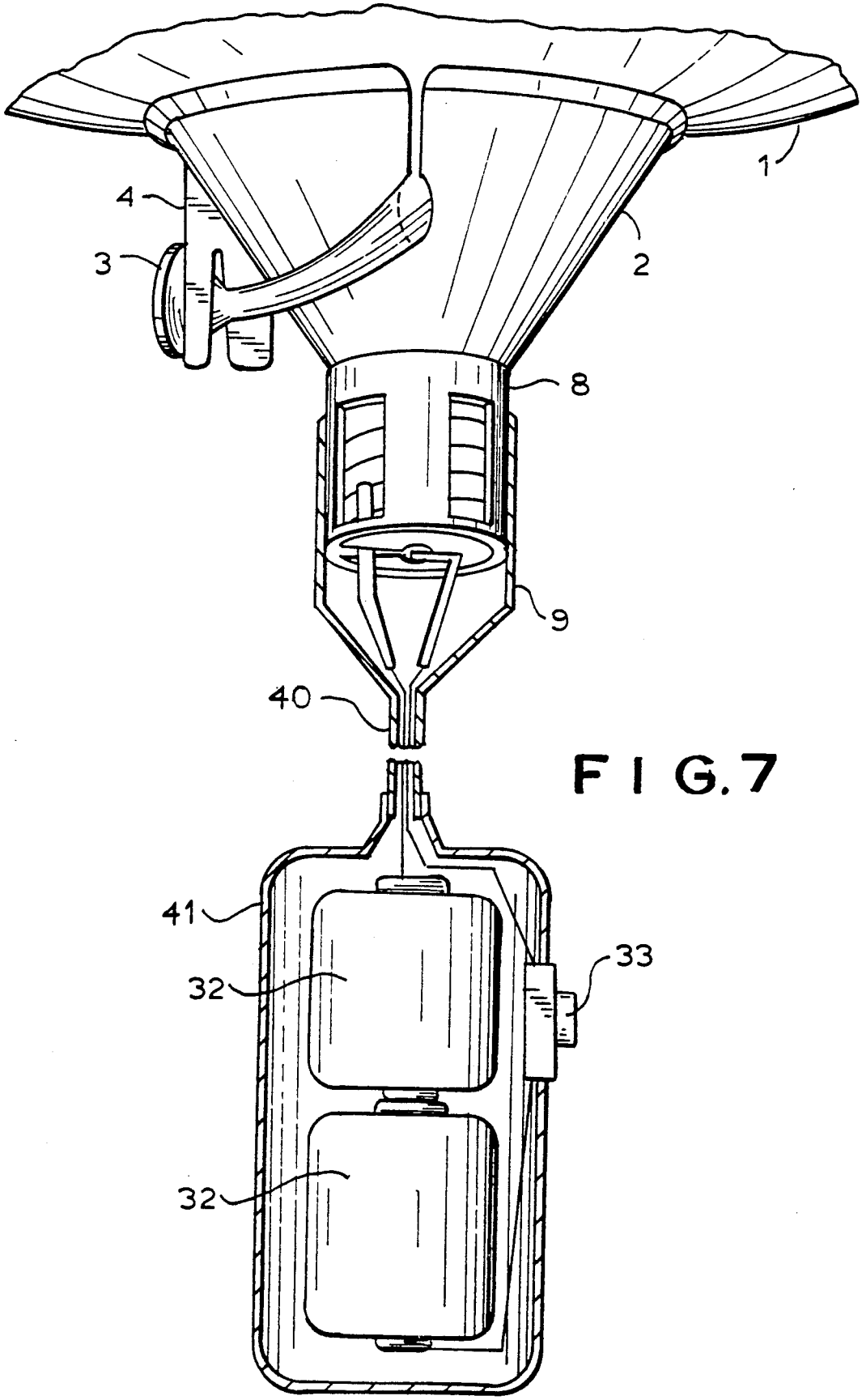
FIG. 7 is a diagram corresponding to FIG. 1 of a further embodiment of the holding device.

In the embodiment shown in FIG. 7, a holding bar 40 is provided which is widened at its upper end in a manner adapted to the cylindrical extension 8 or has a corresponding attachment 9 there. In this case also, the holding bar 40 could again be fastened directly to the bottom of the bowl 2 if illumination of the balloon is not desired, and in such case the cylindrical extension 8 could be developed with a smaller inside diameter and be adapted to be placed for example directly on a wooden bar.

When the holding device is developed as part of an illuminating device, the bar 40 can be provided at its end facing away from the balloon with a battery chamber 41, as shown in FIG. 7, in which batteries 32 and a switch 33 are connected for turning an incandescent bowl, extending into cylindrical recess 8, on and off.

Figure 8:
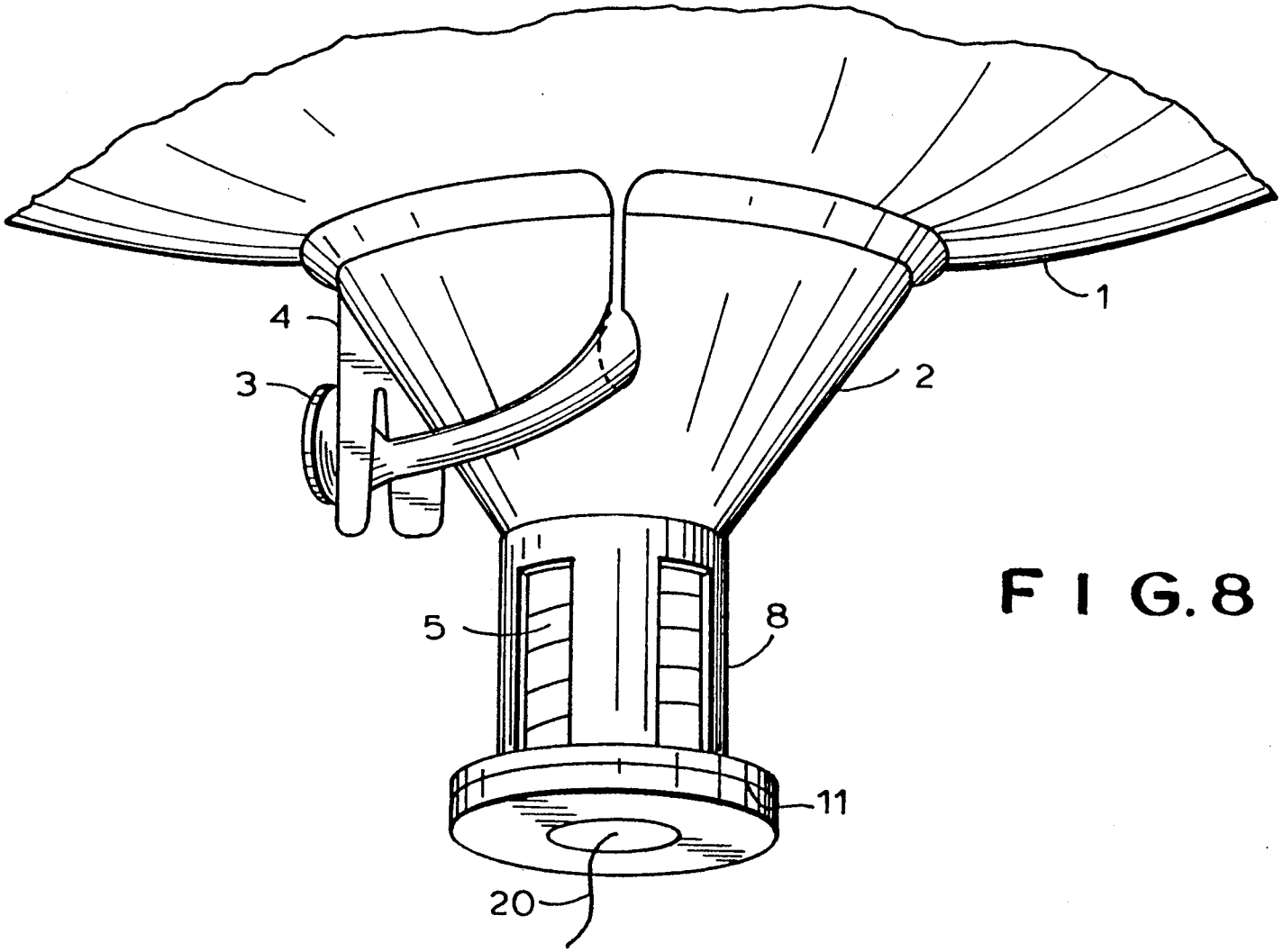
FIG. 8 is a view of another embodiment of the holding device.

Furthermore, as shown in FIG. 8, the cylindrical extension 8 can be developed so as to receive a small battery, for instance in the form of a button-type battery 11, which feeds the incandescent bulb arranged in the lamp socket 5 so that a self-contained illuminating device results. In this case also, a holding rope 20 or holding bar can be arranged on the extension, as shown in the drawing, or such fastening means can be completely eliminated, e.g., in the case of free-flying balloons.

In all embodiments, the bowl 2 can be formed of very light, preferably elastic material, no limitations existing with regard to the shape or size of the bowl.

I claim:

1. A holding device for inflatable balloons (1) which have a balloon envelope and a filling connection (3), said device including a holding part which has the shape of a bowl (2; 2') through which said filling connection extends, said bowl (2; 2') having a circumferential wall that is open towards the balloon (1), clamping means (4, 6, 7; 4, 6', 7') on said bowl for airtight clamping off of the filling connection (3) of the balloon (1) after its inflation, the clamping means including a groove (6, 7; 6', 7') formed in and extending through the circumferential wall of the bowl (2; 2'), the groove starting from a first edge (2a) of the bowl (2; 2') which rests against the balloon envelope upon use and being intended to receive the filling connection (3) of the balloon (1), and a clamping device (4) for the end of the filling connection (3) of the balloon (1), said clamping device being arranged on the outside of the circumferential wall of the bowl (2; 2'), said bowl (2; 2') forming the reflector of an illuminating device for the balloon (1), and an illuminating device, said illuminating device including a lamp socket arranged in said bowl (2; 2') and remote from said first edge (2a) thereof, said lamp socket being constructed and disposed to receive a lamp and position same outside of said envelope and said filling connection, said clamping device (4) being formed by a wall which extends radially outward away from the circumferential wall of the bowl (2; 2') and a clamping groove (4a) in said wall tapering in a direction toward said first edge (2a) to receive the filling connection (3).

2. A holding device according to claim 1 in which the groove (6) extends toward the bottom of the bowl (2) facing away from the balloon (1) in a direction substantially perpendicular to the edge (2a).

3. A holding device according to claim 1 in which the groove (6') extends substantially helically in the circumferential wall starting from the first edge (2a) and toward the bottom of the bowl (2') facing away from the balloon (1).

4. A holding device according to claim 3 in which the groove (6') extends over a circumferential angle of about 90° in the circumferential wall of the bowl (2').

5. A holding device according to claim 1 in which the width of the groove (6; 6'), starting from the first edge (2a) decreases for the clamping of the filling connection.

6. A holding device according to claim 1 in which the wall of the clamping device (4) is arranged on the circumferential wall of the bowl (2; 2') at a circumferential angle of about 90° from the end of the groove (6, 7; 6', 7').

7. A holding device according to claim 1 in which the circumferential wall of the bowl (2; 2') has a frustoconical shape and that its larger end rests against the balloon envelope upon use.

8. A holding device according to claim 1 in which a holding rope (20) for the fastening of the balloon is arranged on the bottom of the bowl.

9. A holding device according to claim 1 in which a holding bar (40) for the balloon can be fastened to the bottom of the bowl.

10. A holding device according to claim 1 in which the wall of the clamping device is integral with the circumferential wall of the bowl.

11. A holding device according to claim 1 in which the wall of the clamping device (4) is arranged on the circumferential wall of the bowl and is offset by a substantial angle from the groove (6, 7) in the circumferential wall.

12. A holding device for inflatable balloons (1) which have a balloon envelope and a filling connection (3), said device including a holding part which has the shape of a bowl (2; 2') through which said filling connection extends said bowl (2; 2') having a circumferential wall that is open towards the balloon (1), clamping means (4, 6, 7; 4, 6', 7') on said bowl for airtight clamping off of the filling connection (3) of the balloon (1) after its inflation, the clamping means including a groove (6, 7; 6'7') formed in and extending through the circumferential wall of the bowl (2; 2'), the groove starting from a first edge (2a) of the bowl (2; 2') which rests against the balloon envelope upon use and being intended to receive the filling connection (3) of the balloon (1), and a clamping device (4) for the end of the filling connection (3) of the balloon (1), said clamping device being arranged on the outside of the circumferential wall of the bowl (2; 2'), said bowl (2; 2') forming the reflector of an illuminating device for the balloon (1) and an illuminating device, said illuminating device including a lamp socket arranged in said bowl (2; 2') and remote from said first edge (2a) thereof, said lamp socket being constructed and disposed to receive a lamp and position same outside of said envelope and said filling connection, said lamp socket being held in a substantially cylindrical extension (8; 8') of the bottom of the bowl (2; 2'), a holding bar (40) fastened to the cylindrical extension (8; 8') of the bottom of the bowl, a battery case (31) for the feeding of the illuminating device, said battery case (31) being arranged on the end of the holding bar (40) facing away from the bowl (2), said clamping device (4) being formed by a wall which extends radially outward away from the circumferential wall of the bowl (2; 2') and a clamping groove (4a) in said wall tapering in a direction toward said first edge (2a) to receive the filling connection (3).

13. A holding device according to claim 12 in which a battery amount (11) is arranged on the lower end of the cylindrical extension (8).

14. A holding device according to claim 13 in which the cylindrical extension of the bottom of the bowl has vent openings (8a).

15. A holding device according to claim 12 in which the lamp socket has a substantially cylindrical recess in the extension (8; 8') in order to receive the base (30) of an incandescent bulb (15a); that a circumferential contact (21, 23, 24) resting against the inner wall of the recess and a center contact (26, 27) extending radially into the recess are arranged in the recess; that the circumferential contact is formed by a strip-shaped electrically conductive elastic element resting against the inner wall of the substantially cylindrical recess, said element having a radially inwardly protruding bend (23) which is intended for engagement with the circumferential surface of the base of the incandescent bulbs; and that the circumferential contact (21, 23, 24) and the center contact (26, 27) are fastened by bending their free end around at least an edge of the cylindrical extension which faces away from the bowl (2').

* * * * *